US009592686B2

(12) United States Patent
Mashima

(10) Patent No.: US 9,592,686 B2
(45) Date of Patent: Mar. 14, 2017

(54) LIQUID EJECTING APPARATUS AND METHOD OF DETECTION

(71) Applicant: SEIKO EPSON CORPORATION, Tokyo (JP)

(72) Inventor: Akira Mashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/991,751

(22) Filed: Jan. 8, 2016

(65) Prior Publication Data

US 2016/0214419 A1 Jul. 28, 2016

(30) Foreign Application Priority Data

Jan. 26, 2015 (JP) ..... 2015-012297

(51) Int. Cl.
*B41J 25/308* (2006.01)
*B41J 2/175* (2006.01)
*B41J 11/20* (2006.01)

(52) U.S. Cl.
CPC ..... *B41J 25/308* (2013.01); *B41J 2/175* (2013.01); *B41J 11/20* (2013.01)

(58) Field of Classification Search
CPC .... B41J 25/304; B41J 25/308; B41J 25/3082; B41J 25/3084; B41J 25/3086
See application file for complete search history.

(56) References Cited

U.S. PATENT DOCUMENTS 5,600,253 A * 2/1997 Cohen ..... G01S 7/02 324/644
2007/0081181 A1* 4/2007 Nobuta ..... B41J 3/4071 358/1.13

FOREIGN PATENT DOCUMENTS

JP 2005-335247 8/2005
JP 2014-124819 7/2014

* cited by examiner

*Primary Examiner* — Stephen Meier
*Assistant Examiner* — Sharon A Polk
(74) *Attorney, Agent, or Firm* — Workman Nydegger

(57) ABSTRACT

A liquid ejecting apparatus includes: a supporting section capable of supporting a medium; an ejecting section capable of ejecting liquid onto the medium supported by the supporting section; and a first detecting section capable of detecting whether an amount of space between the medium supported by the supporting section and the ejecting section is equal to or more than a first threshold value. The liquid ejecting apparatus thus configured makes it possible to prevent liquid from being ejected from an ejecting section onto a medium in a state where an amount of space between the medium and the ejecting section is too large.

9 Claims, 7 Drawing Sheets

LIQUID EJECTING APPARATUS AND METHOD OF DETECTION

BACKGROUND

1. Technical Field

The present invention relates to a liquid ejecting apparatus and a method of detection.

2. Related Art

In the related art, a liquid ejecting apparatus configured to eject liquid onto a medium to form an image on the medium has been used. In such a liquid ejecting apparatus, too small an amount of space between a medium and an ejecting section may bring the medium and the ejecting section into contact with each other, thereby causing a malfunction. For this reason, a technology for preventing an amount of space between a medium and an ejecting section from becoming too small has been disclosed.

For example, JP-A-2014-124819 discloses an image recording apparatus (liquid ejecting apparatus) including a detecting section configured to detect when an amount of space between a medium and an ejecting section has become smaller than a predetermined amount of space.

Meanwhile, there has recently been a demand for a liquid ejecting apparatus capable of both performing high-quality recording and ejecting liquid onto various media of different thicknesses. For this reason, when changing from ejecting liquid onto one medium to ejecting liquid onto another medium, there may be a case where the amount of space between the medium and an ejecting section becomes too large, as well as a case where it becomes too small. If the amount of space between the medium and the ejecting section becomes too large, there are for example a risk of deterioration in recording quality and a risk that an amount of mist that is generated by ejecting liquid may increase and thus stain an inner part of the apparatus or the medium.

SUMMARY

An advantage of some aspects of the invention is that liquid is prevented from being ejected from an ejecting section onto a medium in a state where an amount of space between the medium and the ejecting section is too large.

A liquid ejecting apparatus according to a first aspect of the invention includes: a supporting section capable of supporting a medium; an ejecting section capable of ejecting liquid onto the medium supported by the supporting section; and a first detecting section capable of detecting whether an amount of space between the medium supported by the supporting section and the ejecting section is equal to or more than a first threshold value.

According to the aspect, the first detecting section may be capable of detecting, according to an input quantity of electromagnetic waves, whether the amount of space is equal to or more than the first threshold value.

According to the aspect, the liquid ejecting apparatus may further include an output section capable of, in a case where the amount of space has been detected by the first detecting section as being equal to or more than the first threshold value, outputting information indicating that the amount of space is equal to or more than the first threshold value.

According to the aspect, the liquid ejecting apparatus may further include an amount-of-space adjusting section configured to reduce the amount of space in a case where the amount of space has been detected by the first detecting section as being equal to or more than the first threshold value.

According to the aspect, the liquid ejecting apparatus may further include a second detecting section capable of detecting whether the amount of space is equal to or less than a second threshold value that is smaller than the first threshold value.

According to the aspect, the second detecting section may be capable of detecting, according to an input quantity of electromagnetic waves, whether the amount of space is equal to or less than the second threshold value.

According to the aspect, the liquid ejecting apparatus may further include an output section capable of, in a case where the amount of space has been detected by the second detecting section as being equal to or less than the second threshold value, outputting information indicating that the amount of space is equal to or less than the second threshold value.

According to the aspect, the liquid ejecting apparatus may further include an amount-of-space adjusting section configured to increase the amount of space in a case where the amount of space has been detected by the second detecting section as being equal to or less than the second threshold value.

According to the aspect, the liquid ejecting apparatus may further include a control section configured to, in a case where the amount of space has been detected by the first detecting section and the second detecting section as being more than the second threshold value and less than the first threshold value, control the ejecting section so that the ejecting section forms an image by ejecting the liquid onto the medium supported by the supporting section.

A method of detection according to a second aspect of the invention includes detecting whether an amount of space between a medium supported by a supporting section capable of supporting the medium and an ejecting section capable of ejecting liquid onto the medium supported by the supporting section is equal to or more than a first threshold value.

BRIEF DESCRIPTION OF THE DRAWINGS

The invention will be described with reference to the accompanying drawings, wherein like numbers reference like elements.

DESCRIPTION OF EXEMPLARY EMBODIMENTS

Recording apparatuses serving as liquid ejecting apparatuses according to embodiments of the invention are described below in detail with reference to the accompanying drawings.

Embodiment 1 (FIGS. 1 to 4C)

First, a recording apparatus according to Embodiment 1 of the invention is described.

Figure 1:
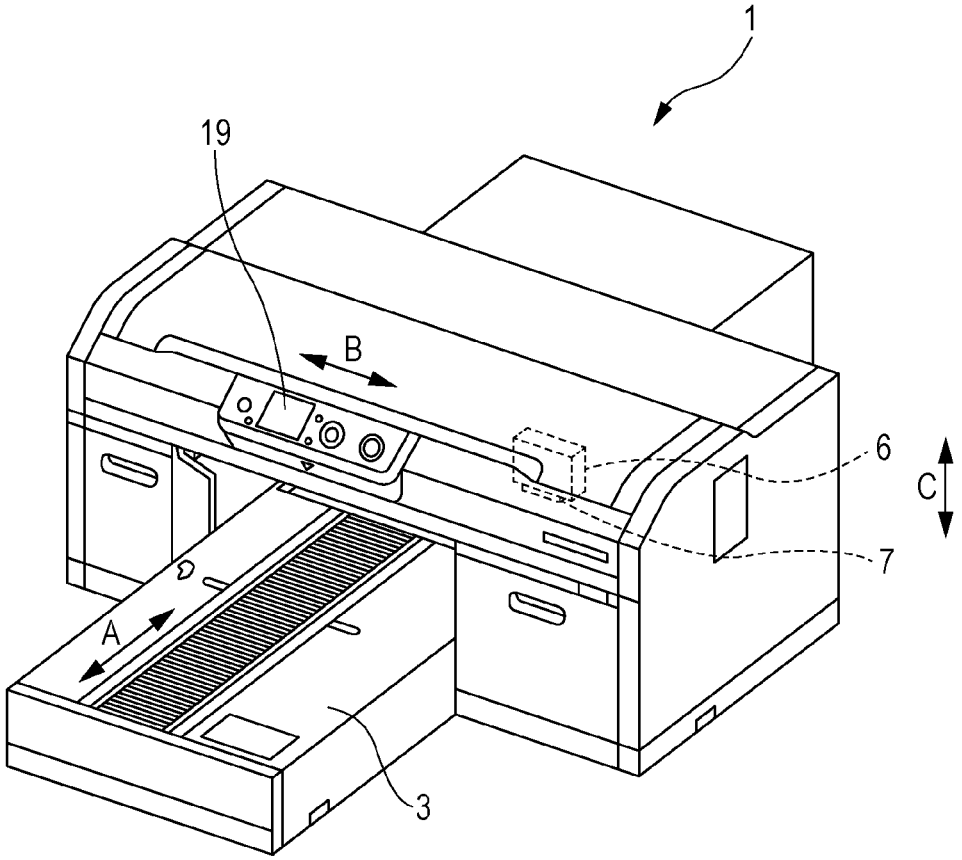
FIG. 1 is a schematic perspective view of a recording apparatus according to Embodiment 1 of the invention.
Figure 2:
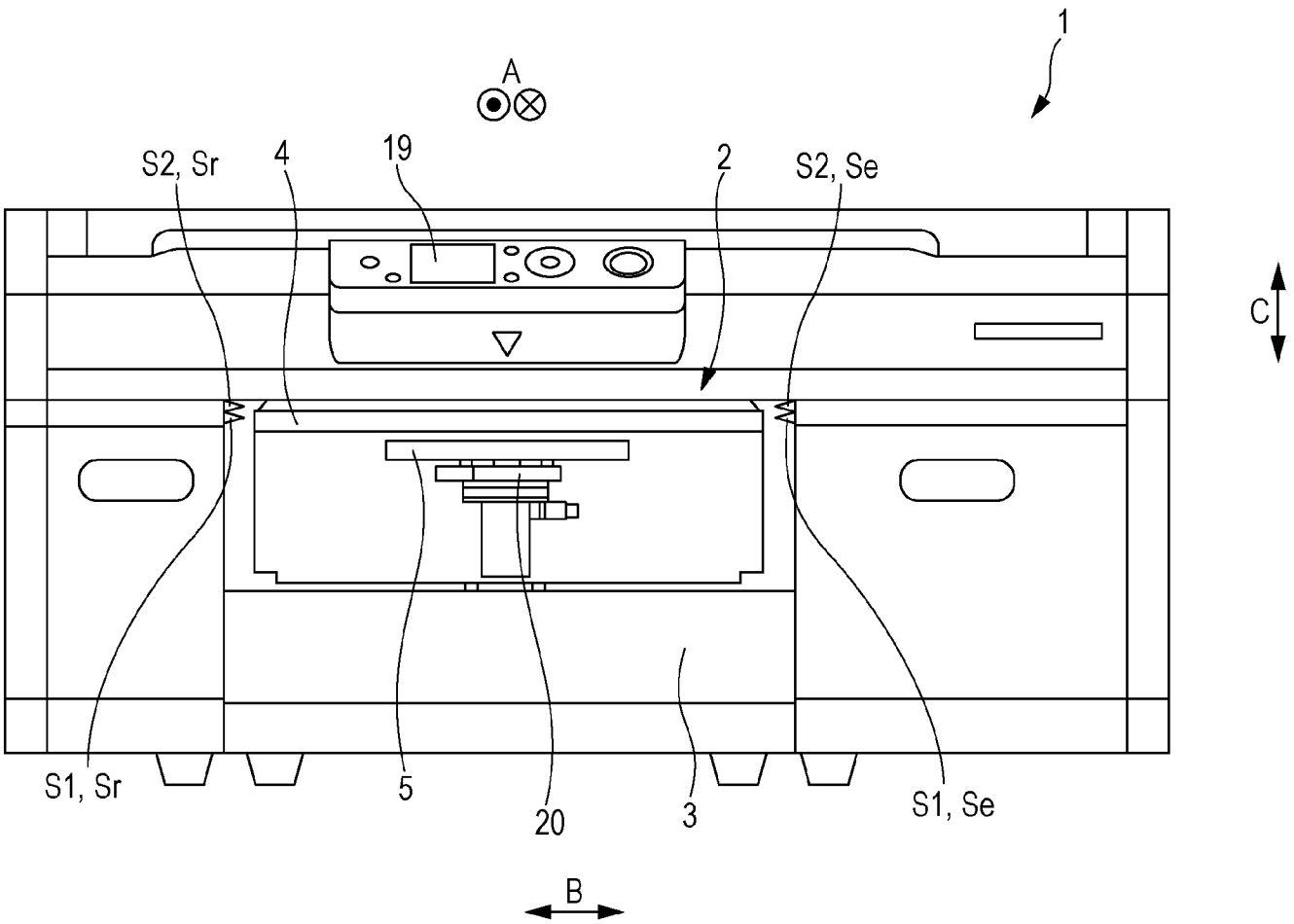
FIG. 2 is a schematic front view of the recording apparatus according to Embodiment 1 of the invention.

FIG. 1 is a schematic perspective view of a recording apparatus 1 according to Embodiment 1 of the invention, and FIG. 2 is a schematic front view of the recording apparatus 1 according to Embodiment 1 of the invention.

The recording apparatus 1 according to Embodiment 1 includes a medium supporting unit 2 configured to move a medium P (see FIGS. 4A to 4C) in either direction of movement A while supporting the medium P. The medium supporting unit 2 includes a tray 4, which serves as a supporting section configured to support a medium. The recording apparatus 1 includes a medium transporting section 3 configured to transport the medium P supported by the tray 4 in either direction of movement A (i.e., to move the medium P and a recording head 7 described later, which serves as an ejecting section, relative to each other). Further, the tray 4 is mounted on a stage 5. Rotating a rotating lever 20 causes the tray 4, together with the stage 5, to move in either height direction C.

It should be noted that the rotating lever 20 can be manually rotated by a user and can also be automatically rotated by a control section 8 (see FIG. 3) controlling a tray moving motor 16.

Further, the recording apparatus 1 includes a body, and the body includes the recording head 7, which is capable of ejecting ink (which is an example of liquid). In Embodiment 1, the recording head 7 corresponds to an ejecting section capable of ejecting liquid onto the medium P. Moreover, the recording apparatus 1 according to Embodiment 1 forms a desired image by causing a carriage 6 provided with the recording head 7 to reciprocate in cross directions B that cross the directions of movement A and thereby causing the recording head 7, which serves as an ejecting section configured to eject ink, to reciprocate and, at the same time, eject the ink onto the medium P supported by the tray 4. That is, the ejecting section is capable of ejecting liquid while moving in the cross directions B that cross the directions of movement A. It should be noted that the recording apparatus 1 according to Embodiment 1 performs recording while moving the tray 4 toward a near side of FIG. 1 (i.e., in a downward and leftward direction in FIG. 1) after moving the tray 4, onto which the medium P has been set, from a set position to a recording start position. The set position, which is a position where the medium P is set onto the tray 4, is located on the near side of FIG. 1. The recording start position is located on a far side of FIG. 1 (which faces in an upward and rightward direction in FIG. 1).

As just described, the recording apparatus 1 according to Embodiment 1 includes the tray 4, which serves as a supporting section capable of supporting a medium P, and the recording head 7, which serves as an ejecting section capable of ejecting ink (which is an example of liquid) onto the medium P supported by the tray 4.

Further, as shown in FIG. 2, the recording apparatus 1 according to Embodiment 1 includes a first sensor S1, which serves as a first detecting section. The first sensor S1 is configured to be able to detect whether an amount of space PG (see FIG. 4A) between the medium P supported by the tray 4 and the recording head 7 is equal to or more than a first threshold value (or whether the amount of space PG is more than the first threshold value).

This configuration allows the recording apparatus 1 according to Embodiment 1 to detect a state where the amount of space PG is too large. This makes it possible to prevent the ink from being ejected from the recording head 7 onto the medium P in a state where the amount of space PG is too large.

It should be noted that the recording apparatus 1 according to Embodiment 1 is capable of detecting whether the amount of space PG is more than the first threshold value, as well as whether the amount of space PG is equal to or more than the first threshold value. However, the following description takes, as an example, a case where the recording apparatus 1 according to Embodiment 1 detects whether the amount of space PG is equal to or more than the first threshold value. Therefore, the clause "whether the amount of space PG is equal to or more than the first threshold value" can be replaced by the clause "whether the amount of space PG is more than the first threshold value".

Furthermore, the recording apparatus 1 according to Embodiment 1 includes a second sensor S2, which serves as a second detecting section capable of detecting whether the amount of space PG is equal to or less than a second threshold value that is smaller than the first threshold value (or whether the amount of space PG is less than the second threshold value).

This configuration makes it possible not only to detect a state where the amount of space PG is too large but also to detect a state where the amount of space PG is too small.

It should be noted that the recording apparatus 1 according to Embodiment 1 is capable of detecting whether the amount of space PG is less than the second threshold value, as well as whether the amount of space PG is equal to or less than the second threshold value. However, the following description takes, as an example, a case where the recording apparatus 1 according to Embodiment 1 detects whether the amount of space PG is equal to or less than the second threshold value. Therefore, the clause "whether the amount of space PG is equal to or less than the second threshold value" can be replaced by the clause "whether the amount of space PG is less than the second threshold value".

Note here that, as shown in FIG. 2, the first sensor S1 and the second sensor S2 each include a light-emitting section Se and a light-receiving section Sr. Moreover, the first sensor S1 is configured to irradiate its light-receiving section Sr with light from its light-emitting section Se and detect, according to whether its light-receiving section Sr has received the light, a state where the amount of space PG is too large, and the second sensor S2 is configured to irradiate its light-receiving section Sr with light from its light-emitting section Se and detect, according to whether its light-receiving section Sr has received the light, a state where the amount of space PG is too small.

In other words, the first sensor S1 is capable of detecting, according to an input quantity of electromagnetic waves, whether the amount of space PG is equal to or more than the first threshold value, and the second sensor S2 is capable of detecting, according to an input quantity of electromagnetic waves, whether the amount of space PG is equal to or less than the second threshold value.

That is, electromagnetic waves allow the first sensor S1 to detect a state where the amount of space PG is too large without making contact with the medium P, and allow the second sensor S2 to detect a state where the amount of space PG is too small without making contact with the medium P.

Consequently, the recording apparatus 1 according to Embodiment 1 is configured to be able to detect the amount of space PG without causing damage to the medium P by making contact with it.

It should be noted that the first sensor S1 and the second sensor S2 according to Embodiment 1 are both configured to emit light along a recording surface of the medium P (i.e., a supporting surface of the medium P) and detect the amount of space PG according to whether the light is received. However, without being limited to such a configuration, the first sensor S1 and the second sensor S2 according to Embodiment 1 may both be configured to emit light toward the recording surface of the medium P (i.e., in a direction that crosses the recording surface of the medium P) and detect the amount of space PG according to the reception intensity of reflection of the light. Note, however, that for higher accuracy of detection of the amount of space PG, it is preferable that, as in Embodiment 1, the first sensor S1 and the second sensor S2 be both configured to emit light along the recording surface of the medium P and detect the amount of space PG according to whether the light is received.

Next, an electrical configuration of the recording apparatus 1 according to Embodiment 1 is described.

Figure 3:
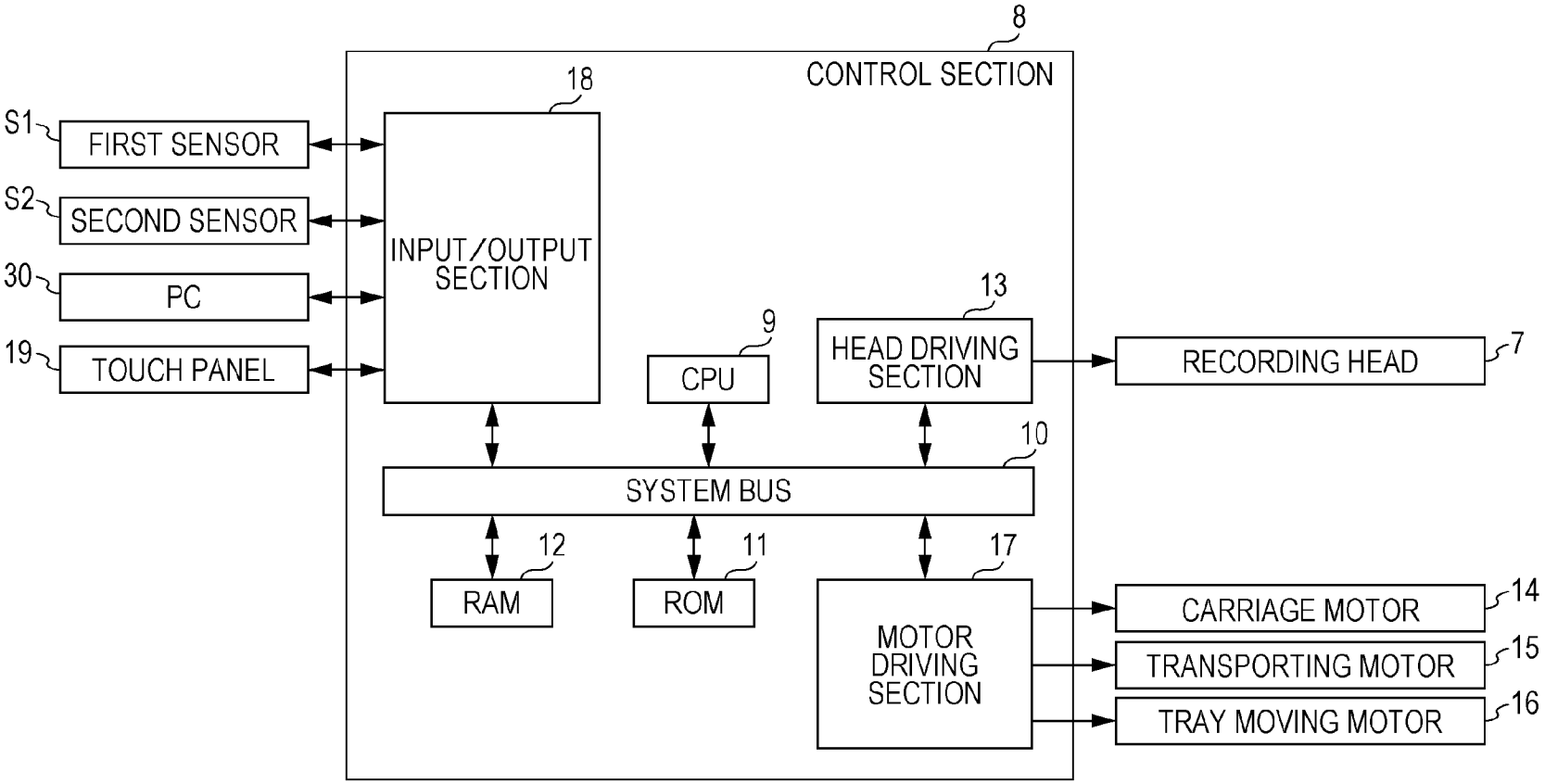
FIG. 3 is a block diagram of the recording apparatus according to Embodiment 1 of the invention.

FIG. 3 is a block diagram of the recording apparatus 1 according to Embodiment 1.

The control section 8 includes a CPU 9 configured to take overall control of the recording apparatus 1. The CPU 9 is connected via a system bus 10 to a ROM 11 and a RAM 12. Various programs, maintenance sequences, and the like that the CPU 9 executes are stored in the ROM 11. In the RAM 12, data can be temporarily stored.

Further, the CPU 9 is connected via the system bus 10 to a head driving section 13 configured to drive the recording head 7.

Further, the CPU 9 is connected via the system bus 10 to a motor driving section 17. Moreover, the motor driving section 17 is connected to a carriage motor 14 configured to move the carriage 6 provided with the recording head 7, a transporting motor 15 provided in the medium transporting section 3 so as to transport the medium P, and the tray moving motor 16, which is configured to rotate the rotating lever 20 to make it possible to adjust the amount of space PG by moving the tray 4 in either height direction C.

Further, the CPU 9 is connected via the system bus 10 to an input/output section 18. The input/output section 18 is connected to the first sensor S1, the second sensor S2, a touch panel 19, and a PC 30 configured to transmit and receive data, such as recording data, and signals.

This configuration enables the control section 8 to execute an image forming operation by controlling the recording head 7 and the medium transporting section 3 so that the recording head 7 performs an ejecting operation and the medium transporting section 3 performs an operation of moving the medium P and the recording head 7 relative to each other.

Note here that the control section 8 can serve as an amount-of-space adjusting section to reduce the amount of space PG by rotating the rotating lever 20 in a case where the amount of space PG has been detected by the first sensor S1 as being equal to or more than the first threshold value. This allows the recording apparatus 1 according to Embodiment 1 to automatically adjust the amount of space PG in a case where the amount of space PG is too large and thereby prevent the ink from being ejected from the recording head 7 to the medium P in the state where the amount of space PG is too large.

Further, the control section 8 can increase the amount of space PG by rotating the rotating lever 20 in a case where the amount of space PG has been detected by the second sensor S2 as being equal to or less than the second threshold value. This allows the recording apparatus 1 according to Embodiment 1 to automatically adjust the amount of space PG in a case where the amount of space PG is too small and thereby prevent the ink from being ejected from the recording head 7 to the medium P in the state where the amount of space PG is too small.

It should be noted that the "case where the amount of space PG has been detected by the first sensor S1 as being equal to or more than the first threshold value" and the "case where the amount of space PG has been detected by the second sensor S2 as being equal to or less than the second threshold value" will be described later.

Further, the control section 8 can serve as an output section that, in a case where the amount of space PG has been detected by the first sensor S1 as being equal to or more than the first threshold value, outputs information indicating that the amount of space PG is equal to or more than the first threshold value to at least either the touch panel 19 or a monitor of the PC 30 via the input/output section 18 and causes the touch panel 19 and/or the monitor to display the information. This makes it possible to notify the user of a state where the amount of space PG is too large.

Furthermore, in a case where the amount of space PG has been detected by the second sensor S2 as being equal to or less than the second threshold value, the control section 8 can output information indicating that the amount of space PG is equal to or less than the second threshold value to at least either the touch panel 19 or the monitor of the PC 30 via the input/output section 18 and cause the touch panel 19 and/or the monitor to display the information. This makes it possible to notify the user of a state where the amount of space PG is too small.

It should be noted that in a state where the amount of space PG is too large or a state where the amount of space PG is too small, the user can choose between executing recording and stopping the execution of recording.

Next, a state where the amount of space PG falls within an appropriate range, a state where the amount of space PG is too small (i.e., a case where the amount of space PG has been detected by the second sensor S2 as being equal to or less than the second threshold value), and a state where the amount of space PG is too large (i.e., a case where the amount of space PG has been detected by the first sensor S1 as being equal to or more than the first threshold value) are described.

Figure 4A:
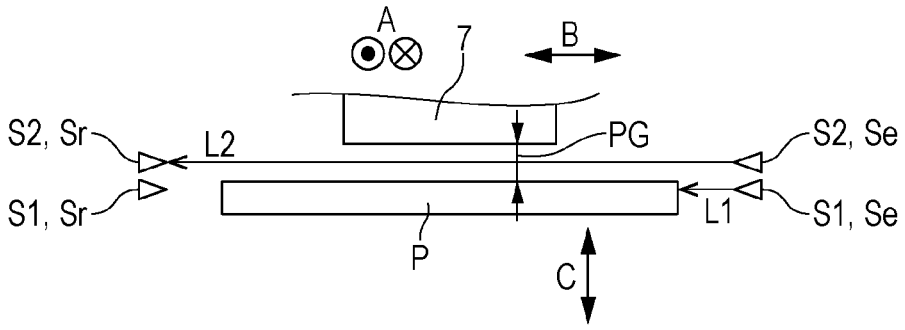
FIG. 4A is a schematic front view of main components of the recording apparatus according to Embodiment 1 of the invention.
Figure 4B:
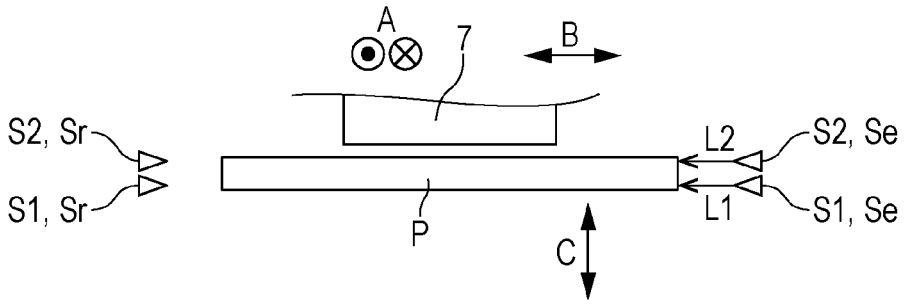
FIG. 4B is a schematic front view of the main components of the recording apparatus according to Embodiment 1 of the invention.
Figure 4C:
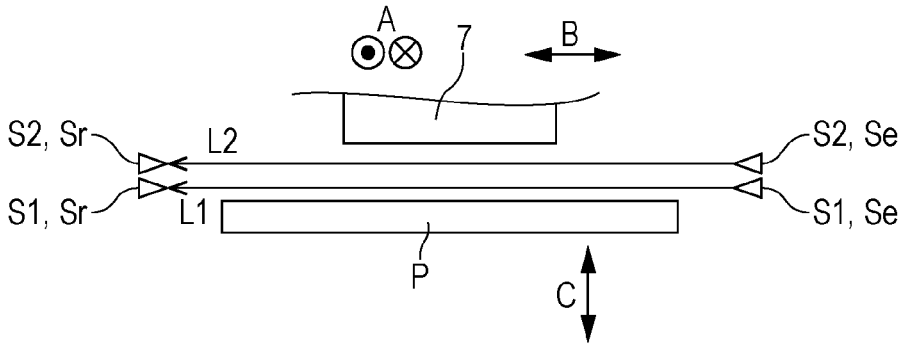
FIG. 4C is a schematic front view of the main components of the recording apparatus according to Embodiment 1 of the invention.

FIG. 4A shows a state where the amount of space PG falls within an appropriate range. FIG. 4B shows a state where the amount of space PG is too small. FIG. 4C shows a state where the amount of space PG is too large.

In a state where the amount of space PG falls within an appropriate range, as shown in FIG. 4A, light L1 emitted from the light-emitting section Se of the first sensor S1 is blocked by the medium P, and light L2 emitted from the light-emitting section Se of the second sensor S2 is received by the light-receiving section Sr of the second sensor S2.

In such a state as that shown in FIG. 4A, the control section 8 determines that the amount of space PG falls within an appropriate range. In other words, the control section 8 determines, on the basis of the fact that the light L1 emitted from the light-emitting section Se of the first sensor S1 is not received by the light-receiving section Sr of the first sensor S1, that the amount of space PG has not become equal to or more than the first threshold value. Moreover, the control section 8 determines, on the basis of the fact that the light L2 emitted from the light-emitting section Se of the second sensor S2 is received by the light-receiving section Sr of the second sensor S2, that the amount of space PG has not become equal to or less than the second threshold value. That is, in a case where the light L1 emitted from the light-emitting section Se of the first sensor S1 is not received by the light-receiving section Sr of the first sensor S1 and the light L2 emitted from the light-emitting section Se of the second sensor S2 is received by the light-receiving section Sr of the second sensor S2, the control section 8 determines that the amount of space PG falls within an appropriate range (i.e., a range of more than the second threshold value to less than the first threshold value).

In a state where the amount of space PG is too small, as shown in FIG. 4B, the light L1 emitted from the light-emitting section Se of the first sensor S1 is blocked by the medium P, and the light L2 emitted from the light-emitting section Se of the second sensor S2 is also blocked by the medium P.

In such a state as that shown in FIG. 4B, the control section 8 determines that the amount of space PG is too small. In other words, the control section 8 determines, on the basis of the fact that the light L2 emitted from the light-emitting section Se of the second sensor S2 is not received by the light-receiving section Sr of the second sensor S2, that the amount of space PG has become equal to or less than the second threshold value. That is, in a case where the light L1 emitted from the light-emitting section Se of the first sensor S1 is not received by the light-receiving section Sr of the first sensor S1 and the light L2 emitted from the light-emitting section Se of the second sensor S2 is not received by the light-receiving section Sr of the second sensor S2, the control section 8 determines that the amount of space PG is too small (i.e., equal to or less than the second threshold value).

In a state where the amount of space PG is too large, as shown in FIG. 4C, the light L1 emitted from the light-emitting section Se of the first sensor S1 is not blocked by the medium P, and the light L2 emitted from the light-emitting section Se of the second sensor S2 is not blocked by the recording head 7.

In such a state as that shown in FIG. 4C, the control section 8 determines that the amount of space PG is too large. In other words, the control section 8 determines, on the basis of the fact that the light L1 emitted from the light-emitting section Se of the first sensor S1 is not received by the light-receiving section Sr of the first sensor S1, that the amount of space PG has become equal to or more than the first threshold value. That is, in a case where the light L1 emitted from the light-emitting section Se of the first sensor S1 is received by the light-receiving section Sr of the first sensor S1 and the light L2 emitted from the light-emitting section Se of the second sensor S2 is received by the light-receiving section Sr of the second sensor S2, the control section 8 determines that the amount of space PG is too large (i.e., equal to or more than the first threshold value).

Thus, in a case where the amount of space PG has been detected by the first sensor S1 and the second sensor S2 as being more than the second threshold value and less than the first threshold value (i.e., in a state shown in FIG. 4A), the control section 8 according to Embodiment 1 controls the recording head 7 so that the recording head 7 forms an image by ejecting the ink onto the medium P supported by the tray 4.

This makes it possible to form an image (eject the ink) with the amount of space PG falling within the appropriate range. Consequently, the recording apparatus 1 according to Embodiment 1 is configured to be able to prevent the medium P and the recording head 7 from making contact with each other, prevent deterioration in recording quality, and prevent an amount of mist that is generated by ejecting the ink from increasing and thus staining an inner part of the apparatus or the medium P.

It should be noted, for example, that the control section 8 according to Embodiment 1 may cause the first sensor S1 to detect whether the amount of space PG is more than the first threshold value and cause the second sensor S2 to detect whether the amount of space PG is less than the second threshold value and, in a case where the amount of space PG has been detected as being equal to or more than the second threshold value and equal to or less than the first threshold vale, may control the recording head 7 so that the recording head 7 forms an image by ejecting the ink onto the medium P supported by the tray 4.

The recording apparatus 1 according to Embodiment 1 is configured to be capable of adjusting the amount of space PG by changing position of the supporting section (tray 4) supporting the medium P in either height direction C. However, without being limited to such a configuration, the recording apparatus 1 may be configured to be capable of adjusting the amount of space PG by changing the position of the recording head 7 in either height direction C.

Furthermore, the invention is also applicable to a recording apparatus (liquid ejecting apparatus) configured totally differently from the recording apparatus 1 according to Embodiment 1.

The following describes recording apparatuses configured differently from the recording apparatus 1 according to Embodiment 1.

Figure 5:
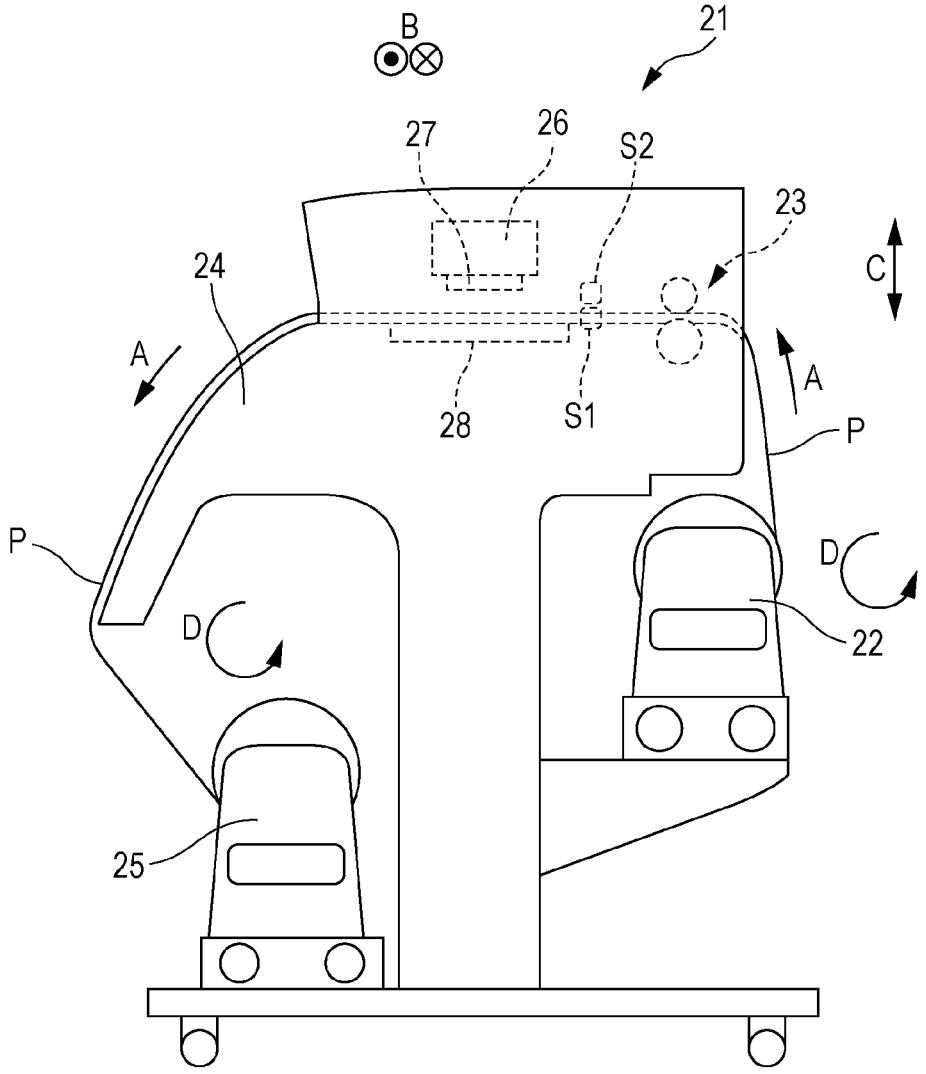
FIG. 5 is a schematic side view of a recording apparatus according to Embodiment 2 of the invention.

Embodiment 2 (FIG. 5)

Next, a recording apparatus according to Embodiment 2 is described.

FIG. 5 is a schematic side view of a recording apparatus 21 according to Embodiment 2.

The recording apparatus 21 according to Embodiment 2 includes a setting section 22 onto which a roll medium P is set, a supporting section 24 configured to support the medium P, and a rewinding section 25 configured to rewind the medium P into a roll. Moreover, the recording apparatus 21 is capable of transporting the medium P in a transport direction A from the setting section 22 to the rewinding section 25 via the supporting section 24. That is, the recording apparatus 21 transports the medium P along a transport path extending from the setting section 22 to the rewinding section 25. The setting section 22 rotates in a direction of rotation D to feed out the medium P, and the rewinding section 25 rotates in the direction of rotation D to rewind the medium P.

Further, the recording apparatus 21 according to Embodiment 1 has transporting rollers 23 provided in the transport path of the medium P. The transporting rollers are constituted by a pair of rollers whose axes of rotation extend in a cross direction B that crosses the transport direction A. This allows the recording apparatus 21 according to Embodiment 1 to be configured such that, in the transport path of the medium P, the transporting rollers 23 transport the medium P fed out from the setting section 22 and the rewinding section 25 rewinds the medium P transported to the rewinding section 25 by the transporting rollers 23.

Further, the recording apparatus 21 according to Embodiment 1 includes a recording head 27, which serves as an ejecting section configured to eject ink. The recording apparatus 21 forms a desired image by causing the recording head 27 to eject ink while causing the recording medium 27 via a carriage 26 to reciprocate along the cross direction B. This configuration allows the recording head 27 to form the image by ejecting the ink onto the medium P.

Provided on an upstream side of the carriage 26 in the transport path of the medium P are a first sensor S1 and a second sensor S2, which are configured in the same way as the first sensor S1 and the second sensor S2 of the recording apparatus 1 according to Embodiment 1.

Further, provided in a place in the supporting section 24 that faces the recording head 27 is a movable platen 28 that can be controlled by a control section (not illustrated) to move in either height direction C.

This configuration enables the recording apparatus 21 according to Embodiment 2 to, in the same way as the recording apparatus 1 according to Embodiment 1, automatically adjust an amount of space PG on the basis of results of detection performed by the first sensor S1 and the second sensor S2.

Figure 6:
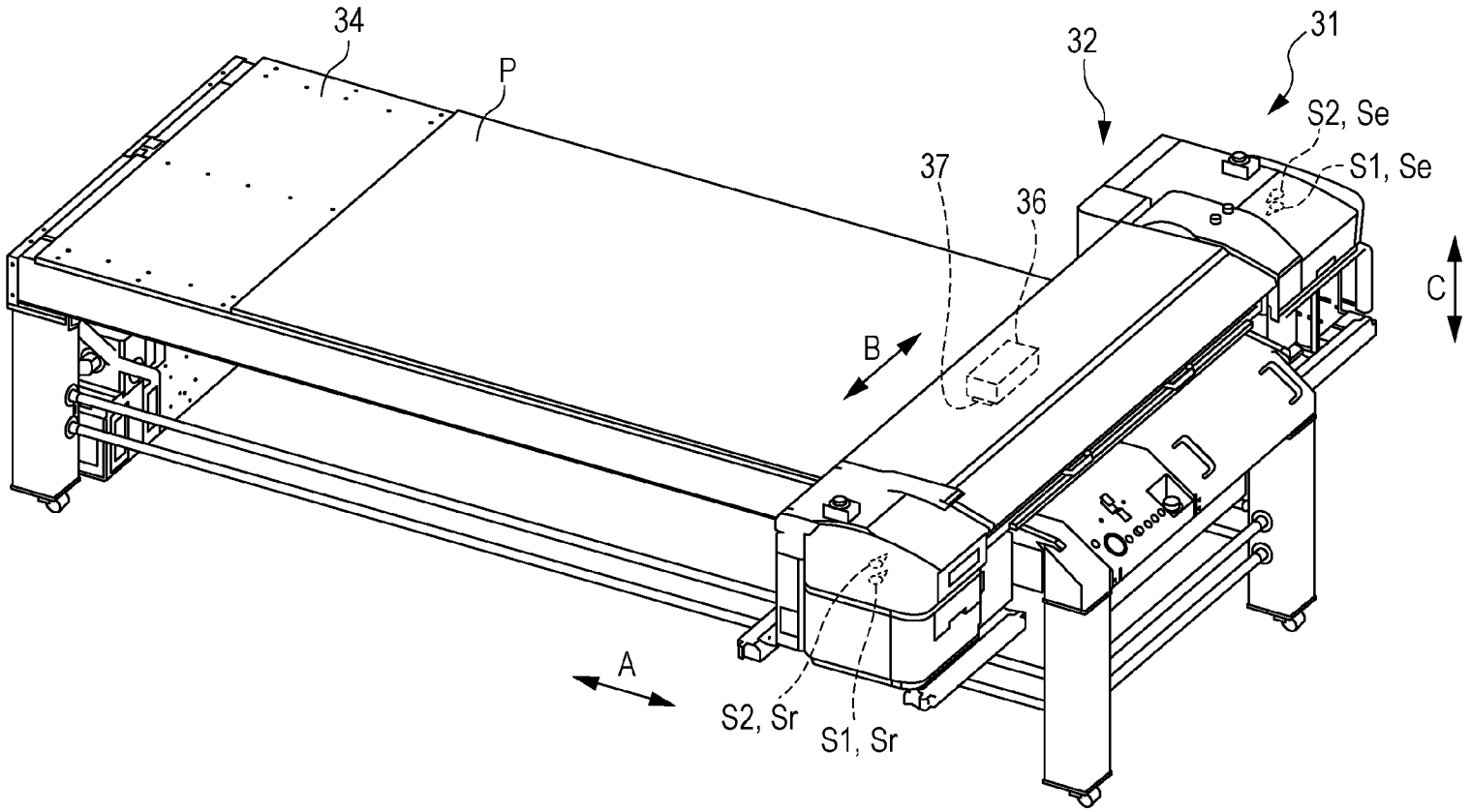
FIG. 6 is a schematic perspective view of a recording apparatus according to Embodiment 3 of the invention.

Embodiment 3 (FIG. 6)

Next, a recording apparatus according to Embodiment 3 is described.

FIG. 6 is a schematic perspective view of a recording apparatus 31 according to Embodiment 3.

The recording apparatus 31 according to Embodiment 3 is a recording apparatus of a so-called flat-bed type. The recording apparatus 31 includes a body section 32 and a medium supporting section (supporting section) 34 capable of supporting a medium P. The body section 32 includes a recording head 37, which serves as an ejecting section configured to eject ink. Moreover, the recording apparatus 31 is capable of moving the recording head 37 in either direction of movement A with respect to the medium supporting section 34. That is, the body section 32 serves also as an ejecting unit capable of moving the medium P and the recording head 37 relative to each other in either direction of movement A.

Further, in the body section 32, the recording head 37 can be moved by a carriage 36 in either cross direction B that crosses the directions of movement A. Moreover, the recording apparatus 31 according to Embodiment 3 forms a desired image by causing the recording head 37 to eject ink onto the medium P while causing the recording head 37 via the carriage 36 to reciprocate in the cross directions B. This configuration allows the recording head 37 to form the image by ejecting the ink onto the medium P.

Note here that provided in the body section 32 are a first sensor S1 and a second sensor S2, which are configured in the same way as the first sensor S1 and the second sensor S2 of each of the recording apparatuses 1 and 21 according to Embodiments 1 and 2.

Further, the body section 32 can be controlled by a control section (not illustrated) to move in either height direction C. Note here that as the body section 32 moves in either height direction C, the first sensor S1 and the second sensor S2 move in the height direction C.

This configuration enables the recording apparatus 31 according to Embodiment 3 to, in the same way as the recording apparatus 1 according to Embodiment 1, automatically adjust an amount of space PG on the basis of results of detection performed by the first sensor S1 and the second sensor S2.

Figure 7:
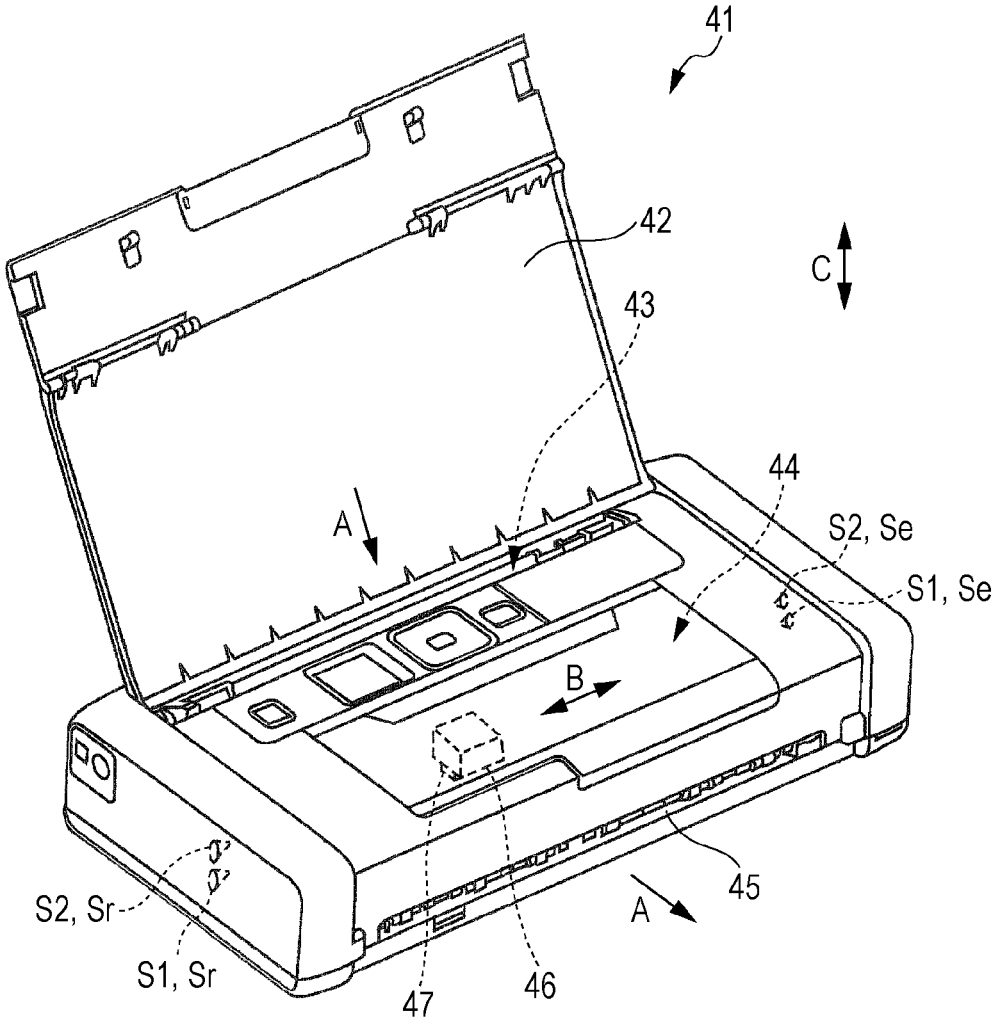
FIG. 7 is a schematic perspective view of a recording apparatus according to Embodiment 4 of the invention.

Embodiment 4 (FIG. 7)

Next, a recording apparatus according to Embodiment 4 is described.

FIG. 7 is a schematic perspective view of a recording apparatus 41 according to Embodiment 4.

The recording apparatus 41 according to Embodiment 4 includes a cover section 42, which serves also as a setting section onto which a medium P is set, a transporting roller 43 provided inside the apparatus, and a delivery section 45. The recording apparatus 41 can use the transporting roller 43 to transport a medium P set on the cover section 42 to the delivery section 45 in a direction of movement A. Provided in a transport path of the medium P are a carriage 46 and a platen 44. The carriage 46 includes a recording head 47, and is capable of reciprocating in cross directions B that cross the directions of movement A. The platen 44 is provided on a side facing the recording head 47, and serves as a supporting section configured to support the medium P. Further provided are a first sensor S1 and a second sensor S2, which are configured in the same way as the first sensor S1 and the second sensor S2 of each of the recording apparatuses 1, 21, and 31 according to Embodiments 1 to 3.

Note here that the platen 44 can by controlled by a control section (not illustrated) to move in either height direction C.

This configuration enables the recording apparatus 41 according to Embodiment 4 to, in the same way as the recording apparatus 1 according to Embodiment 1, automatically adjust an amount of space PG on the basis of results of detection performed by the first sensor S1 and the second sensor S2.

The invention is not limited to the embodiments described above, but may be applied in many variations within the scope of the claims. Such variations are encompassed in the technical scope of the invention.

The invention has been described in detail above with reference to specific embodiments. The invention is summarized again below.

A liquid ejecting apparatus 1 (21, 31, or 41) according to a first aspect of the invention includes: a supporting section 4 (24, 34, or 44) capable of supporting a medium P; an ejecting section 7 (27, 37, or 47) capable of ejecting liquid onto the medium P supported by the supporting section 4 (24, 34, or 44); and a first detecting section S1 capable of detecting whether an amount of space PG between the medium P supported by the supporting section 4 (24, 34, or 44) and the ejecting section 7 (27, 37, or 47) is equal to or more than a first threshold value.

According to the first aspect, the liquid ejecting apparatus 1 (21, 31, or 41) includes a first detecting section S1 capable of detecting whether an amount of space PG between the medium P supported by the supporting section 4 (24, 34, or 44) and the ejecting section 7 (27, 37, or 47) is equal to or more than a first threshold value. This makes it possible to detect a state where the amount of space PG is too large. This in turn makes it possible to prevent the liquid from being ejected from the ejecting section 7 (27, 37, or 47) onto the medium P in a state where the amount of space PG is too large.

In the first aspect, a liquid ejecting apparatus 1 (21, 31, or 41) according to a second aspect of the invention may be configured such that the first detecting section S1 is capable of detecting, according to an input quantity of electromagnetic waves, whether the amount of space PG is equal to or more than the first threshold value.

According to the second aspect, the first detecting section S1 is capable of detecting, according to electromagnetic waves, whether the amount of space PG is equal to or more than the first threshold value. That is, the first detecting section S1 can detect a state where the amount of space PG is too large without making contact with the medium P. This makes it possible to detect the amount of space PG without causing damage to the medium P by making contact with it.

In the first or second aspect, a liquid ejecting apparatus 1 (21, 31, or 41) according to a third aspect of the invention may further include an output section 8 capable of, in a case where the amount of space PG has been detected by the first detecting section S1 as being equal to or more than the first threshold value, outputting information indicating that the amount of space PG is equal to or more than the first threshold value.

According to the third aspect, the recording apparatus 1 (21, 31, or 41) further includes an output section 8 capable of, in a case where the amount of space PG has been detected by the first detecting section S1 as being equal to or more than the first threshold value, outputting information indicating that the amount of space PG is equal to or more than the first threshold value. This makes it possible to notify a user of a state where the amount of space PG is too large.

In any one of the first to third aspects, a liquid ejecting apparatus 1 (21, 31, or 41) according to a fourth aspect of the invention may further include an amount-of-space adjusting section 8 configured to reduce the amount of space PG in a case where the amount of space PG has been detected by the first detecting section S1 as being equal to or more than the first threshold value.

According to the fourth aspect, the liquid ejecting apparatus 1 (21, 31, or 41) further includes an amount-of-space adjusting section 8 configured to reduce the amount of space PG in a case where the amount of space PG has been detected by the first detecting section S1 as being equal to or more than the first threshold value. This makes it possible to automatically adjust the amount of space PG in a state where the amount of space PG is too large and thereby prevent the liquid from being ejected from the ejecting section 7 (27, 37, or 47) onto the medium P in the state where the amount of space PG is too large.

In any one of the first to fourth aspects, a liquid ejecting apparatus 1 (21, 31, or 41) according to a fifth aspect of the invention may further include a second detecting section S2 capable of detecting whether the amount of space PG is equal to or less than a second threshold value that is smaller than the first threshold value.

According to the fifth aspect, the liquid ejecting apparatus 1 (21, 31, or 41) further includes a second detecting section S2 capable of detecting whether the amount of space PG is equal to or less than a second threshold value. This makes it possible not only to detect a state where the amount of space PG is too large but also to detect a state where the amount of space PG is too small.

In the fifth aspect, a liquid ejecting apparatus 1 (21, 31, or 41) according to a sixth aspect of the invention may be configured such that the second detecting section S2 is capable of detecting, according to an input quantity of electromagnetic waves, whether the amount of space PG is equal to or less than the second threshold value.

According to the sixth aspect, the second detecting section S2 is capable of detecting, according to electromagnetic waves, whether the amount of space PG is equal to or less than the second threshold value. That is, the second detecting section S2 can detect a state where the amount of space PG is too small without making contact with the medium P. This makes it possible to detect the amount of space PG without causing damage to the medium P by making contact with it.

In the fifth or sixth aspect, a liquid ejecting apparatus 1 (21, 31, or 41) according to a seventh aspect of the invention may further include an output section 8 capable of, in a case where the amount of space PG has been detected by the second detecting section S2 as being equal to or less than the second threshold value, outputting information indicating that the amount of space PG is equal to or less than the second threshold value.

According to the seventh aspect, the recording apparatus 1 (21, 31, or 41) further includes an output section 8 capable of, in a case where the amount of space PG has been detected by the second detecting section S2 as being equal to or less than the second threshold value, outputting information indicating that the amount of space PG is equal to or less than the second threshold value. This makes it possible to notify the user of a state where the amount of space PG is too small.

In any one of the fifth to seventh aspects, a liquid ejecting apparatus 1 (21, 31, or 41) according to an eighth aspect of the invention may further include an amount-of-space adjusting section 8 configured to increase the amount of space PG in a case where the amount of space PG has been detected by the second detecting section S2 as being equal to or less than the second threshold value.

According to the eighth aspect, the liquid ejecting apparatus 1 (21, 31, or 41) further includes an amount-of-space adjusting section 8 configured to increase the amount of space PG in a case where the amount of space PG has been detected by the second detecting section S2 as being equal to or less than the second threshold value. This makes it possible to automatically adjust the amount of space PG in a state where the amount of space PG is too small and thereby prevent the liquid from being ejected from the ejecting section 7 (27, 37, or 47)onto the medium P in the state where the amount of space PG is too small.

In any one of the fifth to eighth aspects, a liquid ejecting apparatus 1 (21, 31, or 41) according to a ninth aspect of the invention may further include a control section 8 configured to, in a case where the amount of space PG has been detected by the first detecting section S1 and the second detecting section S2 as being more than the second threshold value and less than the first threshold value, control the ejecting section 7 (27, 37, or 47) so that the ejecting section 7 (27, 37, or 47) forms an image by ejecting the liquid onto the medium P supported by the supporting section 4 (24, 34, or 44).

According to the ninth aspect, the liquid ejecting apparatus 1 includes a control section 8 configured to, in a case where the amount of space PG has been detected by the first detecting section S1 and the second detecting section S2 as being more than the second threshold value and less than the first threshold value, control the ejecting section 7 (27, 37, or 47) so that the ejecting section 7 (27, 37, or 47) forms an image by ejecting the liquid onto the medium P supported by the supporting section 4 (24, 34, or 44). This makes it possible to form an image (eject the ink) with the amount of space PG falling within an appropriate range. This in turn makes it possible to prevent the recording head 7 from making contact with the medium P, prevent deterioration in recording quality, and prevent an amount of mist that is generated by ejecting the liquid from increasing and thus staining an inner part of the apparatus or the medium P.

A method of detection according to a tenth aspect of the invention includes detecting whether an amount of space PG between a medium P supported by a supporting section 4 (24, 34, or 44) capable of supporting the medium P and an ejecting section 7 (27, 37, or 47) capable of ejecting liquid onto the medium P supported by the supporting section 4 (24, 34, or 44) is equal to or more than a first threshold value.

According to the tenth aspect, whether an amount of space PG is equal to or more than a first threshold value is detected. This makes it possible to detect a state where the amount of space PG is too large. This in turn makes it possible to prevent the liquid from being ejected from the ejecting section 7 (27, 37, or 47) onto the medium P in a state where the amount of space PG is too large.

The invention makes it possible to prevent liquid from being ejected from an ejecting section onto a medium in a state where an amount of space between the medium and the ejecting section is too large.

The entire disclosure of Japanese Patent Application No. 2015-012297, filed Jan. 26, 2015 is expressly incorporated reference herein.

What is claimed is:

1. A liquid ejecting apparatus, comprising:

a supporting section capable of supporting a medium;

an ejecting section capable of ejecting liquid onto the medium supported by the supporting section;

a first detecting section capable of detecting whether an amount of space between the medium supported by the supporting section and the ejecting section is equal to or more than a first threshold value; and a second detecting section capable of detecting whether the amount of space is equal to or less than a second threshold value that is smaller than the first threshold value.

2. The liquid ejecting apparatus according to claim 1, wherein the first detecting section is capable of detecting, according to an input quantity of electromagnetic waves, whether the amount of space is equal to or more than the first threshold value.

3. The liquid ejecting apparatus according to claim 1, further comprising an output section capable of, in a case where the amount of space has been detected by the first detecting section as being equal to or more than the first threshold value, outputting information indicating that the amount of space is equal to or more than the first threshold value.

4. The liquid ejecting apparatus according to claim 1, further comprising an amount-of-space adjusting section configured to reduce the amount of space in a case where the amount of space has been detected by the first detecting section as being equal to or more than the first threshold value.

5. The liquid ejecting apparatus according to claim 1, wherein the second detecting section is capable of detecting, according to an input quantity of electromagnetic waves, whether the amount of space is equal to or less than the second threshold value.

6. The liquid ejecting apparatus according to claim 1, further comprising an output section capable of, in a case where the amount of space has been detected by the second detecting section as being equal to or less than the second threshold value, outputting information indicating that the amount of space is equal to or less than the second threshold value.

7. The liquid ejecting apparatus according to claim 1, further comprising an amount-of-space adjusting section configured to increase the amount of space in a case where the amount of space has been detected by the second detecting section as being equal to or less than the second threshold value.

8. The liquid ejecting apparatus according to claim 1, further comprising a control section configured to, in a case where the amount of space has been detected by the first detecting section and the second detecting section as being more than the second threshold value and less than the first threshold value, control the ejecting section so that the ejecting section forms an image by ejecting the liquid onto the medium supported by the supporting section.

9. A method of detection, the method comprising:

detecting by a first detection section whether an amount of space between a medium supported by a supporting section capable of supporting the medium and an ejecting section capable of ejecting liquid onto the medium supported by the supporting section is equal to or more than a first threshold value; and detecting by a second detection section whether the amount of space is equal to or less than a second threshold value that is smaller than the first threshold.

* * * * *